United States Patent [19]

Ziemek

[11] Patent Number: 4,738,734

[45] Date of Patent: Apr. 19, 1988

[54] METHOD FOR THE PRODUCTION OF A FLEXIBLE ELECTRIC LINE

[75] Inventor: Gerhard Ziemek, Langenhagen, Fed. Rep. of Germany

[73] Assignee: Kabelmetal Electro Gesellschaft mit Beschränkter Haftung, Hanover, Fed. Rep. of Germany

[21] Appl. No.: 6,470

[22] Filed: Jan. 21, 1987

[30] Foreign Application Priority Data

Jan. 31, 1986 [DE] Fed. Rep. of Germany ..... 3602966

[51] Int. Cl.[4] ..... H01B 13/08

[52] U.S. Cl. ..... 156/53; 156/56; 156/162; 156/195; 156/259; 174/108; 174/109

[58] Field of Search ..... 156/53, 195, 271, 244.18, 156/259, 162, 56; 174/108, 109

[56] References Cited

U.S. PATENT DOCUMENTS

| | | | |
|---|---|---|---|
| 2,224,810 | 12/1940 | Cumfer | 156/195 X |
| 2,262,636 | 11/1941 | Cuno | 156/195 X |
| 3,435,602 | 4/1969 | Sheets | 156/53 X |
| 3,716,435 | 2/1973 | Jensen et al. | 156/195 |
| 3,756,004 | 9/1973 | Gore | 156/53 X |
| 3,993,531 | 11/1976 | Davila et al. | 156/53 X |
| 4,572,452 | 2/1986 | Driscoll et al. | 156/259 X |
| 4,595,619 | 6/1986 | Krus | 156/259 X |

*Primary Examiner*—Robert A. Dawson
*Attorney, Agent, or Firm*—Martin A. Farber

[57] ABSTRACT

A method of producing a shielding for a flexible electric line employs at least one conductor having insulation upon which is wound at least one metal tape, the tape being separated into individual elements by cutting immediately before contacting the insulation.

8 Claims, 2 Drawing Sheets

METHOD FOR THE PRODUCTION OF A FLEXIBLE ELECTRIC LINE

DESCRIPTION

Field and Background of the Invention

The present invention refers to a method of producing a flexible electric line having at least one insulated conductor, by which at least one covering consisting of a plurality of individual metallic elements is applied over the insulation of the conductor.

Such lines comprise, for instance, low-frequency (LF) lines in which the metal covering serves as shielding, or high frequency (HF) lines in which the metal covering represents the outer conductor in coaxial embodiments and the shielding in symmetrical embodiments.

LF lines are required, for instance, for electro-acoustics and for audio-frequency measurement techniques. For this purpose they must be protected well by suitable shielding from disturbing external fields, and they must themselves radiate only slightly towards the outside. Depending on their purpose of use, the demands made on such lines differ greatly. Thus, for instance, highly sensitive microphone circuits require particularly effective shielding of the lines used.

LF lines having only a single conductor in the form of a stranded wire can be used, for instance, for crystal microphones, magnetic recording heads and dictating machines. In two-wire embodiment they serve, for instance, as connecting cable for microphones and loudspeakers. They can also be used as connecting cable between magnetic-tape recorders and radio receivers. Another possible use wherein the line comprises, for instance, three wires is the use as instrument cable and as connecting cable in the field of automatic control and regulation.

Coaxial HF lines are used in many fields of electrical communication engineering, for instance in direction-finding and antenna systems. For uses in which a particularly high shielding action is required, such lines are also equipped, for instance, with a double metal covering. Symmetrical HF lines are used preferably in short-wave, radio and television receiving systems.

In the known cables, the coverings are developed generally as a braid in which, for instance, bare or tinned copper wires are incorporated. For the production of the braids, two layers each consisting, for instance, of eight individual wires with opposite direction of lay are stranded or woven around the insulated conductors so as to form a closed braid. One problem in the production of the braid resides in the guidance of the individual wires, which are produced with accurate dimensions in expensive pre-production and wound on spools. These individual wires must be guided so accurately that they lie parallel to each other in each layer or direction of lay in the cable. The guides for the individual wires are parts subject to wear which must be frequently replaced because of the precision required upon the feeding of the individual wires. One definite disadvantage of the known cables having a metallic covering which is developed as a braid resides, however, in the very low speed of production of such braids. Lines containing braid in their structure could be manufactured up to now, therefore, only at great manufacturing expense and in time-consuming manner.

SUMMARY OF THE INVENTION

The object of the prsent invention is to provide a method by which flexible electric cables can be provided with a suitably electrically shielding covering at reduced cost of manufacture and with increased speed of production without the flexibility of the cables being impaired.

This object is achieved in accordance with the invention in a method of the aforementioned type, wherein a metal tape is wrapped as covering around the insulation of the conductor and, directly before the tape contacts the insulation, is separated into individual elements by cuts extending parallel to the direction of the tape.

By this method the rate of production for the manufacture of flexible shielded cables can be substantially increased since with a one-layer development of the metallic covering, substantially only one metal tape is wound on the line. The flexibility of the cable is, however, retained since, prior to its application onto the cable, the metal tape is cut into a plurality of individual elements which are no longer attached to each other in their wrapped state. Upon the feeding of the metal tape to the line, no great expense is necessary and no costly pre-production of a large number of individual elements is required either. The covering produced by this method results in an electric shielding action which corresponds to that of simple braids. The expression "shield" which is used generally here applies also to coaxial HF cable the outer conductor of which also has a shielding effect.

The high speed of production possible affords a further advantage in that, in the same operation as the application of the covering, a sheathing can also be extruded onto it, in a so-called tandem process.

For improved shielding action a two-layer covering can be applied, the covering produced from two metal tapes wound with opposite direction of lay on the line. In this connection it is possible to make the width of the individual elements in the two layers different. Thereby it is possible, with constant flexibility, to obtain a practically complete metallic covering of the surrounded conductor or conductors.

BRIEF DESCRIPTION OF THE DRAWINGS

The method of the invention will be explained below on basis of an example with reference to the drawings, in which.

DETAILED DESCRIPTION OF THE PREFERRED EMBODIMENTS

Figure 1:
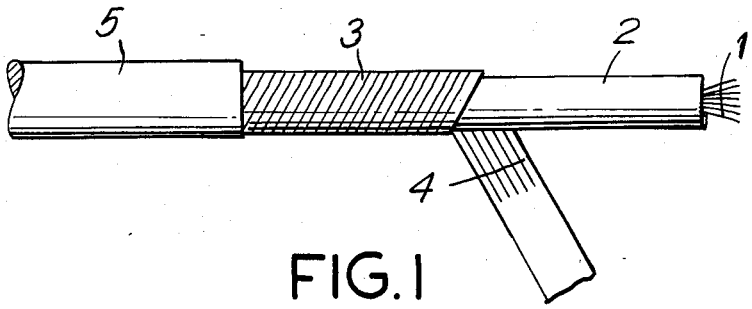
FIGS. 1 and 2 show two different electric lines with metallic covering.

FIG. 1 shows a line which can be used, for instance, as a shielded flexible connecting line for dictating machines. It has a stranded conductor (1) which may consist of bared or tinned copper wires. Over the stranded conductor (1) there is disposed an insulation (2) which consists, for instance, of polyethylene or polyvinylchloride. Over the insulation (2) there is disposed a metallic covering (3) consisting of a large number of individual elements (4) which are wound in the same direction of lay parallel to each other and tightly against each other over the insulation (2). The covering (3) represents the shielding of the line. A sheathing (5) consisting for instance of polyvinylchloride is placed over the covering (3).

Figure 2:
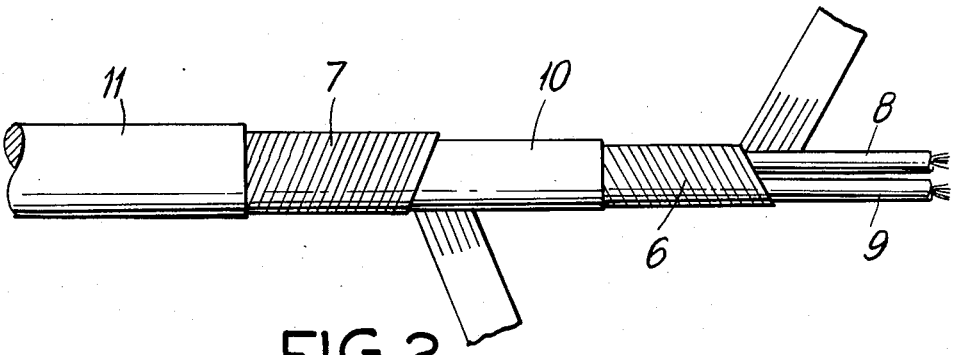

The line of FIG. 2 is constructed with a metallic covering which consists of two layers (6) and (7), the layers being applied with opposite direction of lay. Such a line can be used as LF line, for instance as connecting line for loudspeakers. As HF line it can be used, for instance, for television receivers. The line has two insulated wires (8) and (9) comprising conductors which are formed as stranded conductors. The two wires (8) and (9) may extend parallel to each other, or else, be stranded to each other. Over the wires (8) and (9) there are disposed the layers (6) and (7) of the metallic covering, between which an insulating layer (10) is provided. A sheathing (11) consisting, for instance, of polyvinylchloride, is disposed over the layer (7) of the metallic covering.

Figure 4:
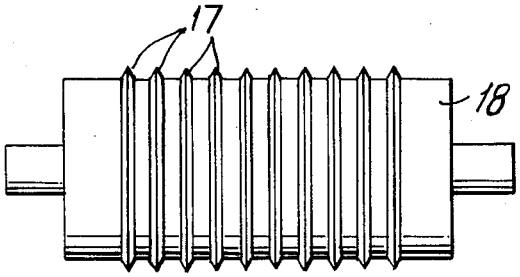
FIGS. 4 and 5 show details of FIG. 3 on a larger scale.
Figure 5:
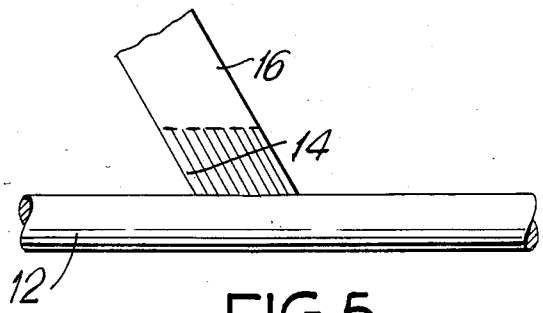
Figure 3:
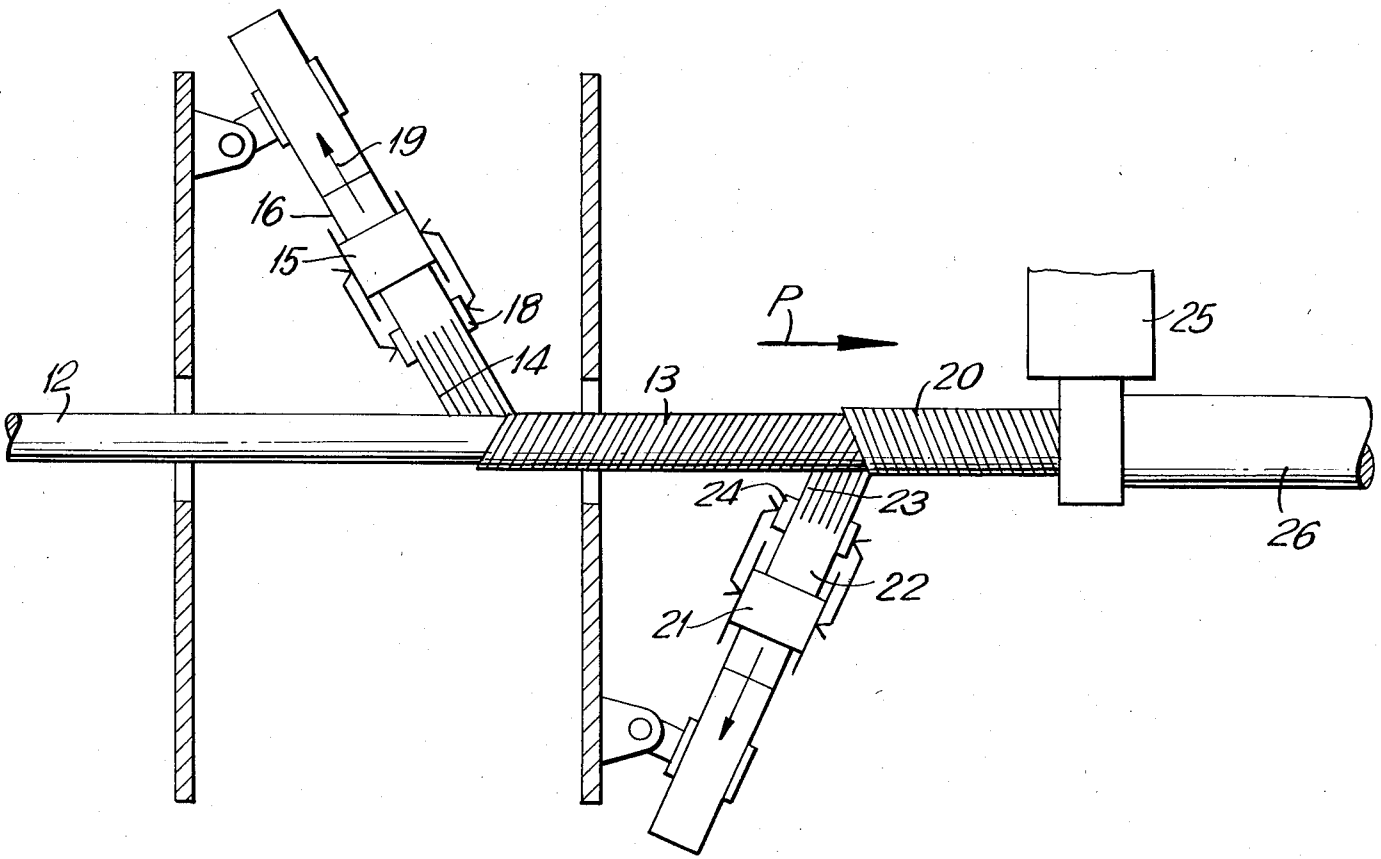
FIG. 3 shows diagrammatically an apparatus for the carrying out of the method of the invention.

The method of the invention by which the covering (3) and the two layers (6) and (7) are applied will be explained below with reference to FIGS. 3, 4 and 5.

An insulated conductor (12) is withdrawn from a coil (not shown) and advanced in the direction indicated by the arrow (P). Over the insulation of the conductor (12) there is applied a metallic cover (13) which consists of a plurality of individual elements (14). For this purpose a metal tape (16) supplied by a reel (15) is wrapped around the conductor (12) without overlap and without gaps. The metal tape (16) can consist, for instance, of copper or of tinned copper. Directly before coming against the conductor (12) or the insulation thereof the metal tape (16) is separated by cuts extending in the direction of the tape into the individual elements (14) which then lie as parts independent of each other tightly against each other on the insulation of the conductor (12). Separating of the individual elements (14) is accomplished by knives (17) which are fastened on a drum (18) as can be noted diagrammatically from the enlarged showing of FIG. 4.

Reel (15) and drum (18) are fastened on a frame which is rotatable around the conductor (12) in a plane extending at right angles to the plane of the drawing. Such a frame can, for instance, be a tangential spinner known from the cabling technique. The knives (17) are advisedly arranged replaceably on the drum (18). In this connection, the possibility can also be provided of making the distance between the knives (17) variable so that individual elements (14) of different width can be produced.

The drum (18) is mounted rotatably. In addition it can also be driven. In both cases it is necessary for the knives to be constructed as revolving knives. If a rotatable drum is not used, revolving knives also can not be used. Instead of a drum (18) on which all knives required are jointly fastened there can in principle also be used individual knives which are arranged, for instance, on a rotatable cross member (not shown). There is then the possibility, in accordance with FIG. 5, of so separating the individual elements (14) that from the beginning of the cut until the arrival on the conductor (12) they all have approximately the same length. This results in an advantage in that the individual elements (14) can definitely not travel out of their predetermined position. Such travel is, to be sure, not to be feared even with the manner of operation already described since the reel (15) is pressed continuously in the direction of the arrow (19) so that the metal tape (16) is always sufficiently tensioned.

An additional layer (20) of the metallic covering can be applied in the same operation on the covering (13). This layer (20) is in principle applied in the same way as the covering (13) but with opposite direction of lay. A metal tape (22) supplied via a reel (21) is wound for this purpose on the covering (13) and directly before arrival on the covering (13) separated into individual elements (23). For this purpose there can once again be used knives which are arranged on a drum (24). The structure and manner of operation of the arrangement for the application of the layer (20) are identical with the construction described for the application of the covering 13. If the distance between the knives on the drums (18) and (24) is variable, then individual elements (14) and (23) of different width can be produced in the two layers of the covering.

In principle an insulating layer can furthermore first of all be applied over the covering (13) before the layer (20) is wound on.

After the application of the layer (20) of the metallic covering, the line shielded with it can be wound on a reel (not shown). However, it is also possible to feed the line in a so-called tandem process directly to an extruder (25) in which an insulating and protective sheathing (26) is applied in the same operation. The finished line can then be wound on a reel.

Instead of only one conductor (12) two or more insulated conductors on which the covering (13) is applied can also be used. The sheathing (26) can also be pressed already onto the covering (13) if only a single-layer metal covering or shielding is desired for the line.

What is claimed is:

1. A method of producing a flexible electric line having at least one insulated conductor, by which method at least one metallic covering comprising a plurality of metallic individual elements is applied as a winding and an insulation of the conductor; the method comprising the steps of:

winding a metal tape, as covering, around the insulation of the conductor; and separating the tape into individual elements by cuts extending parallel to the direction of the tape directly before an engagement of the tape with the insulation during said step of winding.

2. A method according to claim 1, comprising a step of tensioning the metal tape during said winding step.

3. A method according to claim 1 wherein said step of separating provides that the individual elements have approximately the same length from beginnings of the cuts up to the points of engagement of the individual elements with a winding encircling the insulation.

4. A method according to claim 1, wherein said step of separating includes a cutting of the tape by rotatably mounted knives.

5. A method according to claim 4, wherein said cutting is accomplished by driving the knives.

6. A method according to claim 1 wherein said step of winding includes a winding of two metal tapes as covering of the insulation; and said step of separating includes separating the two tapes into individual elements which are applied as windings with opposite direction of lay.

7. A method according to claim 6, wherein the width of the individual elements of one of said tapes in a winding of one lay differs from the width of the individual elements of the tape in the winding of the other lay.

8. A method according to claim 1, further comprising a step of forming a jacket upon the metal covering concurrently with said winding step.

* * * * *